United States Patent [19]

von Böckh

[11] 4,257,360

[45] Mar. 24, 1981

[54] FEED WATER PREHEATER

[75] Inventor: Peter von Böckh, Hohentengen-Herdern, Fed. Rep. of Germany

[73] Assignee: BBC Brown Boveri & Company Limited, Baden, Switzerland

[21] Appl. No.: 59,103

[22] Filed: Jul. 19, 1979

[30] Foreign Application Priority Data

Aug. 18, 1978 [CH] Switzerland ..... 8780/78

[51] Int. Cl.[3] ..... F22D 1/00

[52] U.S. Cl. ..... 122/412; 122/428; 122/510

[58] Field of Search ..... 122/412, 417, 422, 425, 122/426, 428, 444, 451 R, 460, 467, 510, 235 G, 31 R

[56] References Cited

U.S. PATENT DOCUMENTS

| | | | |
|---|---|---|---|
| 410,509 | 9/1889 | Field | 122/428 |
| 526,727 | 10/1894 | Morriss et al. | 122/425 |
| 1,480,912 | 1/1924 | Martin | 122/426 |
| 3,958,629 | 5/1976 | Andersson | 122/510 |
| 4,120,350 | 10/1978 | Norton | 122/510 |
| 4,148,281 | 4/1979 | Stoll et al. | 122/510 |
| 4,182,276 | 1/1980 | Hededam | 122/412 |

*Primary Examiner*—Henry C. Yuen

*Attorney, Agent, or Firm*—Burns, Doane, Swecker & Mathis

[57] ABSTRACT

A feed water preheater has an integral desuperheater and an integral supercooler through which passes the feed water tube bundle. To prevent the penetration of steam into the supercooler at the point where the feed water tube bundle passes from the supercooler into the condensation space through a support plate, the tubes of the tube bundle are surrounded by sleeves which are fixed to the support plate. Steam flowing through the sleeves condenses and fills the sleeves to prevent the entry of steam into the supercooler. Sleeves are also provided at points where the tubes pass between the desuperheater and condensation space to reduce the velocity of steam traveling from the former to the latter. The latter sleeves can be oriented vertically in the case of a vertical preheater, as long as they are longer than the thickness of condensate disposed on the support plate in the condensation space.

14 Claims, 2 Drawing Figures

L'
4'
10'
7'
8'
9'
1
Δ'
4
2
2A
7
10
3
5
6
A
B

FEED WATER PREHEATER

BACKGROUND AND OBJECTS OF THE INVENTION

The invention relates to a feed water preheater of the type comprising a condensation space, an integral supercooler and a tube bundle through which feed water which is to be preheated is intended to flow.

In such preheaters, the tube bundle extends between the supercooler and the condensation space through a support plate which serves as a partition between the supercooler and the condensation space. A clearance is provided between the individual tubes and openings provided for the tubes in the support plate, to accommodate relative thermal expansion.

For thermodynamic reasons, it is desired in feed water preheaters having an integral supercooler that the condensate be supercooled along a part of the length of the entire tube bundle so as to heat feed water in the tubes. Accordingly, with the preheater disposed in a horizontal arrangement, the condensate is sucked from the condensation space into the supercooler by a syphoning effect. However, because of the differential thermal expansion of the tubes and the supercooler inserts, and for various constructional reasons, the tubes cannot be fixed completely tightly against the first support plate of the supercooler. Hence, the above-mentioned clearance is provided. Since a reduced pressure, relative to the condensation space, prevails in the supercooler, steam can be sucked from the condensation space into the supercooler through the resulting gaps between the openings in the support plates and the tubes passing therethrough. This steam flow can break the syphoning effect and subject the tubes to the risk of erosion-corrosion.

To ensure the operability of the preheater, it is therefore necessary to eliminate or reduce the quantity of steam attempting to flow through these gaps into the supercooler so that the steam can fully condense and the syphoning effect is not broken. This could be achieved by selecting a very large wall thickness for the first support plate and a particularly small clearance between the external diameter of the tubes and the openings in the support plate. However, as a result, it would be necessary to use tubes with a particularly narrow tolerance margin and to machine the openings in this support plate with special precision. Such measures would have a very disadvantageous effect on the manufacturing costs and also entail technical problems since the tubes could jam in the support plate and damage to the tubes would be possible in the case of thermally caused differential expansions.

It is, therefore, one object of the present invention to provide a feed water preheater which avoids the above-described disadvantages.

It is another object of the invention to enable a reliable seal to be obtained between the condensation space and the supercooler, while employing production tolerances, and without high additional costs.

SUMMARY OF THE INVENTION

In accordance with the invention, the individual tubes of the tube bundle of the feed water preheater are surrounded by sleeves joined to the support plate. Accordingly, by providing a small clearance between the sleeves and the outer surface of the tubes, and a suitably dimensioned length of the sleeves, the annular gap which is formed between the individual sleeves and the tubes surrounded by the sleeves is filled with steam condensate at least over a part of the length of the sleeves during operation of the preheater, to prevent entry of steam into the supercooler.

In the case where a desuperheater is integral with the preheater, greater pressure prevails in the desuperheater than in the condensation space due to the loss of velocity of the steam. As a result, steam flows from the desuperheater into the condensation space via the gaps between the openings in the support plates and the tubes passing therethrough. If high steam velocities occur in these gaps, the feed water tubes are subjected to a risk of erosion or corrosion or droplet impact corrosion. Accordingly, in the case of preheaters having an integral desuperheater, wherein the tube bundle extends into the condensation space from the desuperheater space through a second support plate, serving as a partition between the desuperheater space and the condensation space, and wherein clearance is provided between the individual tubes and the openings provided for the tubes in the support plate, it is advantageous to surround the individual tubes of the tube bundle by sleeves which extend into the interior of the condensation space from a side of the second support plate facing away from the desuperheater space, and which are joined to the second support plate. In this case, it is an advantage to dimension the clearance between the inner wall of the sleeve and the outer surface of the tubes, and the length of the sleeves such that, when the preheater is operating, the steam flow velocity through the sleeve is reduced to a value at which there is no risk of erosion-corrosion on the tubes at this point. Preferably, such velocity should be lower than 35 m/second.

It is also an advantage in the case of a vertical arrangement of the preheater, in which the condensation space is disposed above the desuperheater space, that the length of the sleeves extending into the condensation space be greater than the layer thickness of the condensate present on top of the second support plate.

It has also proved to be advantageous for the length of the sleeves to be at least 70 mm, preferably at least 150 mm, and the difference between the diameter of the bores of the sleeves and the external diameter of the tubes surrounded by these sleeves to be in the range from 0.1 to 0.6 mm, preferably in the range from 0.4 to 0.5 mm.

THE DRAWING

In the following text, preferred embodiments of the invention are explained by reference to the accompanying drawing in which:

FIG. 1 is a longitudinal section through a feed water preheater according to the invention, FIG. 2 is an enlarged longitudinal section through a sealing sleeve provided between the condensation space and the supercooler and viewed from the opposite side of the preheater relative to FIG. 1, FIG. 3 is an enlarged longitudinal section through tube openings provided in the case of a vertical arrangement of the preheater, between the desuperheater and the condensation space, and FIG. 4 is a longitudinal view, similar to FIG. 2 through a sleeve which surrounds a gap between the condensation space and the desuperheater.

DETAILED DESCRIPTION OF A PREFERRED EMBODIMENT OF THE INVENTION

Figures 1, 4:
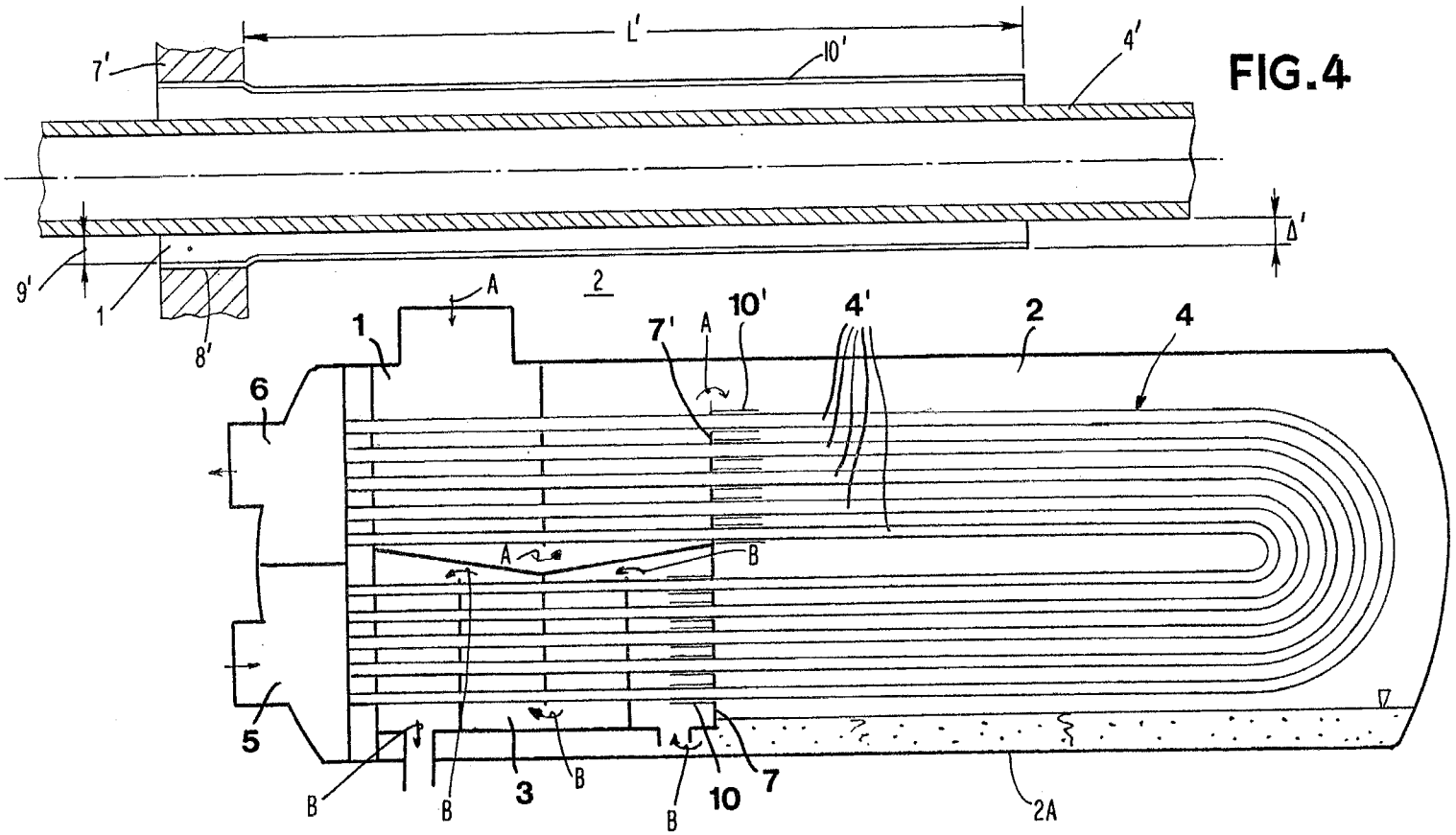

As can be seen from FIG. 1, the feed water preheater shown has an integral desuperheater 1, a condensation space 2, an integral supercooler 3 and a tube bundle 4, through which the feed water which is to be preheated is intended to flow. The tube bundle 4 extends from the feed water inlet 5 through the supercooler 3, the condensation space 2 and through the desuperheater 1 up to the feed water outlet 6. Spent steam is directed into the desuperheater 1 in the direction of the arrows A and thence into the condensation space 2 where the steam condenses onto the floor 2A thereof. During this travel, heat is given-up to water in the tubes 4' of the tube bundle 4. By means of a syphoning effect, the condensate travels through the supercooler 3 in the direction of arrows B, so that additional heat is given-up to the water.

The condensate space is separated from the supercooler 3 by a last support plate 7 and from the desuperheater 1 by a first support plate 7'.

Figure 2:
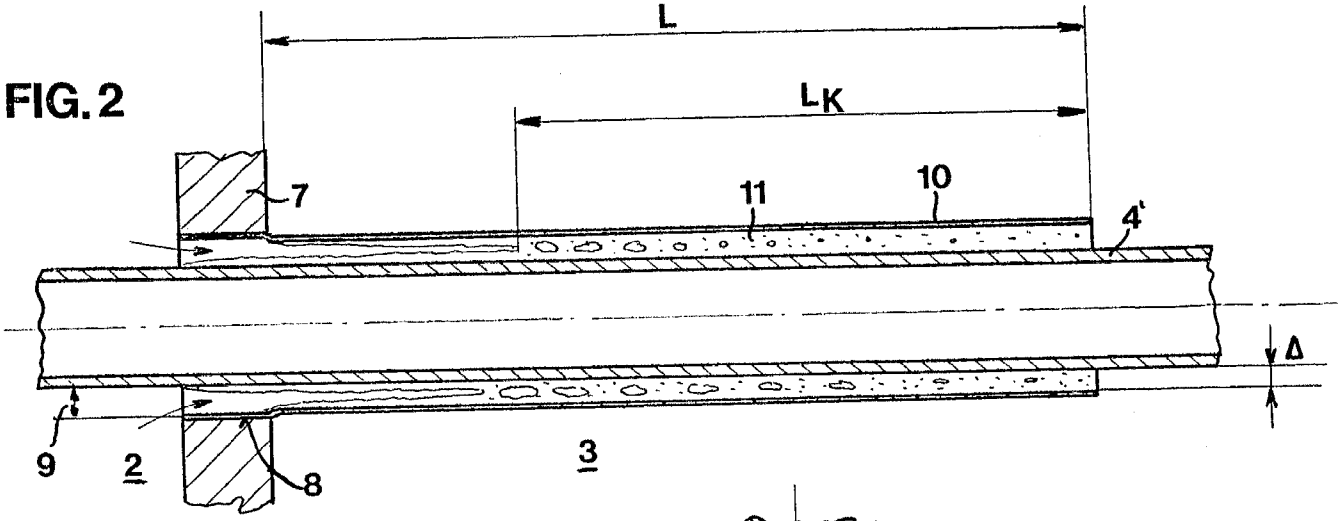

Because of the differential thermal expansion of the tubes 4' of the tube bundle 4 and the supercooler inserts, a clearance 9 is provided between the individual tubes 4' and the passage bores 8 provided for the tubes in the last support plate 7, as can be seen from FIG. 2.

In order now to achieve, between the supercooler space 3 and the condensation space 2, in spite of the clearance, a steam seal between the last support plate 7 and the tubes 4' passing therethrough, when the preheater is operating, the individual tubes 4' of the tube bundle 4 are surrounded by metal sleeves 10. The sleeves 10 are connected to and extend from a side of the last support plate 7 facing away from the condensation space 2 and project into the interior of the supercooler 3.

Note that in FIG. 2 the sleeves 10 are viewed from a side of the preheater which is opposite that which the preheater is viewed in FIG. 1. That is, the sleeves 10 extend right-to-left in FIG. 1 and left-to-right in FIG. 2.

The clearance $\Delta$ between the inner surface of the sleeve 10 and the outer surface of the associated tube 4' and the length L (i.e., the length located within the condensation space 2) of the sleeves 10 are selected such that, when the preheater is operating, steam traveling through the annular gap 11 between the individual sleeves 10 and the tubes 4' condenses. Accordingly, the sleeve is filled, at least over a part $L_K$ of the length L of the sleeve, with steam condensate originating from steam which has condensed out on the cold tube wall surfaces. In this way, all steam which penetrates the annular gap 11, condenses before reaching the inlet to the supercooler 3. That is, no steam passes from the condensation space 2 into the supercooler 3. Preferably, the length L of the sleeves extending into the supercooler 3 is at least 70 mm, and more preferably is at least 150 mm, and can be from 200 to 250 mm. The difference between the diameters of the sleeve 10 and tube 4' is in the range of from 0.1 to 0.6 mm, and more preferably from 0.4 to 0.5 mm.

In the case of a tube 4' of 15 mm external diameter, it has proved advantageous to dimension the length L of the sleeves 10 as 200 mm and to dimension the difference between the external diameter of the tubes and the internal diameter of the sleeves as, at most, 0.5 mm. Of course, other combinations of dimensions would also suffice, it being only necessary that the clearance $\Delta$ be small enough and the length L be long enough to assure that steam will condense before reaching the supercooling section 3. Many suitable combinations of dimensions are easily discernable by those skilled in the art.

The thin-walled metal sleeves 10 are, for example as can be seen from FIG. 2, rolled into bores 8 in the last support plate 7.

In spite of the steam seal, achieved in this way between the condensation space 2 and the supercooler 3, the tubes 4' are freely displaceable with respect to the last support plate 7 and the sleeves 10, and it is relatively cheap and constructionally simple to provide sleeves 10 of this type in the preheater.

Moreover, the individual tubes 4' of the tube bundle 4 are surrounded by the sleeves 10' which are connected to and extend from a side of the first support plate 7' facing away from the desuperheater space 1. The sleeves 10'project into the interior of the condensation space 2.

A complete condensation of steam flowing through an annular space 11' between the sleeves 10' and the tubes 4', would only be achievable if very long sleeves 10' are used. Therefore, in practice, it must suffice to select the clearance $\alpha'$ between the inner surface of these sleeves 10' and the outer surface of the tubes 4', and the length L' (i.e., the length located within the condensation space 2) of these sleeves 10', in such a way that, when the preheater is operating, the annular space 11' forms a seal, within which the flow velocity is reduced to a value at which there is no risk of erosion-corrosion on the tubes 4' at this point. That is, the flow velocity of the steam should be lower than 35 m/second. Preferably, the length L' of the sleeve 10' extending into the condensation space 2 is at least 150 mm, and can be from 200 to 250 mm. The difference between the diameters of the sleeve 10' and the tube 4' is in the range of from 0.1 to 0.6 mm, and more preferably from 0.4 to 0.5 mm.

As a practical example, in the case where the length L' of the sleeves 11' is about 200 mm, the difference between the internal diameter of the sleeves and the external diameter of the tubes should be, at most, 0.5 mm.

Figure 3:
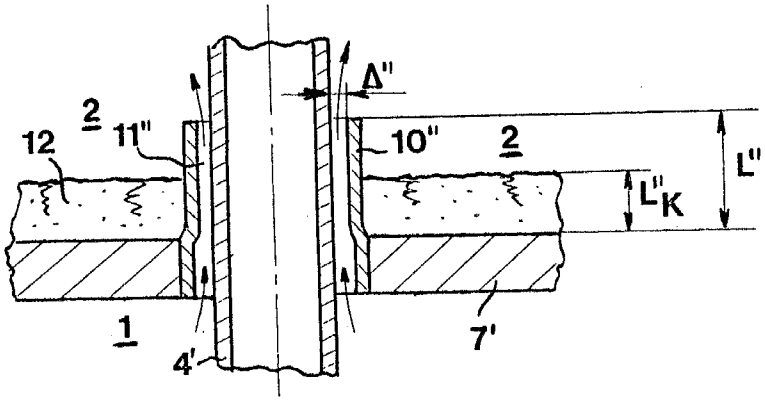

In the case where the preheater is arranged vertically (see FIG. 3), in which the condensation space 2 is located above the desuperheater space 1, care must be taken to avoid droplet impact corrosion. This can be done by making the length L'' of the sleeves 10'' extending into the condensation space 2 greater than the layer thickness $L_K''$ of the condensate 12 which, when the preheater is operating, is present on the top of the support plate 7', so that the condensate 12 present on the support plate 7' is not carried along by the steam flowing through the annular gap 11' and is not thrown against the surface of the tubes 4'.

Although the invention has been described in connection with a preferred embodiment thereof, it will be appreciated by those skilled in the art that additions, modifications, substitutions and deletions not specifically described may be made without departing from the spirit and scope of the invention as defined in the appended claims.

What is claimed is:

1. In a feed water preheater of the type comprising a condensation space, a supercooler section, and a tube bundle extending within said supercooler section and said condensation space for conducting feed water which is to be preheated by steam conducted through said supercooler section, said tube bundle passing through a support plate which partitions said supercooler section from said condensation space, clearance being provided between individual tubes of said tube bundle and openings in said support plate through which said tubes pass, the improvement wherein said tubes are surrounded by sleeves extending from said support plate, there being provided an annular gap between said sleeves and said tubes, said annular gap being filled with steam condensate along at least a portion of the length thereof during operation of the preheater, to prevent the entry of steam into said condensation space.

2. Preheater according to claim 1, further including a desuperheater section, said tube bundle extending between said desuperheater section and said condensation space through a second support plate forming a partition between said desuperheater section and said condensation space, clearance being provided between said individual tubes and passage bores provided for said tubes in said second support plate, the individual tubes being surrounded by second sleeves which are joined to said second support plate and extend from a side of said second support plate facing away from said desuperheater section and into the interior of said condensation space.

3. Preheater according to claim 2, wherein a clearance is provided between the inner surface of said second sleeves and the outer surfaces of said tubes forms an annular gap within which the flow velocity of steam is reduced to a value which eliminates risk of erosion and corrosion of the tubes.

4. Preheater according to claim 2, wherein said first-named support plate and said second support plate are integrally united.

5. Preheater according to claim 2, wherein said preheater is oriented vertically wherein said condensation space is disposed above said desuperheater space and said tube bundle extends vertically therebetween, the length of said second sleeves extending into said condensation space is greater than the layer thickness of condensate present on top of said second support plate.

6. Preheater according to claim 3, wherein said flow velocity value is less tha 35 m/second.

7. Preheater according to claim 5, wherein a clearance is provided between the inner surface of said second sleeves and the outer surfaces of said tubes forms an annular gap within which the flow velocity of steam is reduced to a value which eliminates risk of erosion and corrosion of the tubes, said flow velocity value is less than 35 m/second.

8. Preheater according to claim 1, wherein the length of said sleeves extending from said support plate is at least 70 mm, and the difference between the internal diameter of said sleeves and the external diameter of said tubes is in the range of from 0.1 to 0.6 mm.

9. Preheater according to claim 8, wherein said difference is in the range from 0.4 to 0.5 mm.

10. Preheater according to claim 8, wherein said length is at least 150 mm.

11. Preheater according to claim 8, wherein said length is in the range of from 200 to 250 mm.

12. Preheater according to claim 8, wherein said difference is preferably in the range of from 0.4 to 0.5 mm.

13. Preheater according to claim 1, wherein said sleeves are rolled into said openings in said support plate.

14. Preheater according to claim 1, wherein said sleeves which extend into the interior of the supercooler from a side of said support plate facing away from said condensation space and are joined to said support plate.

* * * * *